US007116757B2

(12) United States Patent
Apel et al.

(10) Patent No.: US 7,116,757 B2
(45) Date of Patent: Oct. 3, 2006

(54) X-RAY TUBE WITH ROTARY ANODE

(75) Inventors: Manfred Apel, Rudolstadt (DE); Holger Baule, Oberweissbach (DE); Jörg Freudenberger, Eckental (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/994,112

(22) Filed: Nov. 19, 2004

(65) Prior Publication Data

US 2005/0157845 A1 Jul. 21, 2005

(30) Foreign Application Priority Data

Nov. 9, 2003 (DE) ..... 103 53 964

(51) Int. Cl.
*H01J 35/10* (2006.01)

(52) U.S. Cl. ..... 378/130; 378/141

(58) Field of Classification Search ..... 378/130, 378/141, 143, 144, 119, 121, 199, 200
See application file for complete search history.

(56) References Cited

U.S. PATENT DOCUMENTS

| | | | | |
|---|---|---|---|---|
| 3,694,685 | A | 9/1972 | Houston | 378/130 |
| 4,577,340 | A | 3/1986 | Carlson et al. | 378/132 |
| 4,674,109 | A * | 6/1987 | Ono | 378/130 |
| 6,084,942 | A | 7/2000 | Hell et al. | 378/200 |
| 6,327,340 | B1 * | 12/2001 | Runnoe | 378/130 |
| 6,364,527 | B1 | 4/2002 | Kutschera | 378/200 |
| 6,396,901 | B1 | 5/2002 | Hell et al. | 378/130 |

FOREIGN PATENT DOCUMENTS

| | | |
|---|---|---|
| DE | 34 39 799 | 2/1986 |
| DE | 36 44 719 | 3/1988 |
| EP | 0 330 336 | 8/1989 |
| EP | 0 576 258 | 12/1993 |
| EP | 1 047 100 | 10/2000 |

* cited by examiner

*Primary Examiner*—Courtney Thomas
(74) *Attorney, Agent, or Firm*—Schiff Hardin LLP

(57) ABSTRACT

An x-ray tube has an anode plate connected to an anode tube that is mounted such that it can rotate around a rigid anode shaft. To improve the heat dissipation from the anode plate, a liquid for dissipation of heat to the anode shaft is accommodated in an intervening space formed between the anode shaft and the anode plate.

15 Claims, 2 Drawing Sheets

X-RAY TUBE WITH ROTARY ANODE

BACKGROUND OF THE INVENTION

1. Field of the Invention

The present invention concerns an x-ray tube of the type having a rotary anode that rotates on a rigid shaft.

2. Description of the Prior Art

An x-ray tube of the above type is known from Japanese Application 3228992. In this known x-ray tube, an node plate Is attached to the closed end of an anode tube via a short, rigid axle. The anode tube is mounted on the rigid axle such that it can rotate. In the area of the end of anode tube, a fluid metal is incorporated for improving heat dissipation from the anode plate. Although, the heat transfer from such an anode plate to a cooling device incorporated into the anode axle is improved, in the manner a further improvement of the cooling of the anode plate would be desirable to improve the overall performance of such an x-ray tube.

Rotary piston radiators are known from German OS 197 41 750, German PS 198 51 853 as well as German OS 199 56 491 wherein a rotary drum surrounding an anode plate is incorporated in a rotatable fashion in a housing. Located between an inner surface of the housing and an outer surface of the rotary piston is a liquid coolant that circulates around the rotary piston to dissipate heat. Rotary piston radiators have the advantage that large amounts of heat can be removed. The high performance drive needed for the rotary piston is, however, disadvantageous.

European Application 1 047 100 discloses an x-ray tube in which an anode plate is mounted onto a rigid hollow anode axle such that it can rotate. The anode plate is hollow in sections thereof and liquid coolant flows through it for heat dissipation. The coolant is supplied and removed via the hollow anode axle. This x-ray tube is complicated in terms of design and therefore expensive to manufacture.

German PS 36 44 719 describes a liquid-cooled x-ray tube. A cylindrically designed rotary anode is mounted to rotate around a cooler. The cooler in turn encloses, as an annular channel, a rotatably supported anode axle connected with the rotary anode. A liquid metal for improving heat dissipation is disposed between an outer surface of the cooler and an inner surface of the rotary anode.

U.S. Pat. No. 4,577,340 describes an x-ray tube in which an anode plate is firmly connected with a hollow anode axle. The anode plate is partially hollow and is supplied with liquid coolant via the anode axle. Additional x-ray tubes with hollow liquid-cooled anode plates are known, for example, from European Application 0 576 258 as well as European Application 0 330 336. X-ray tubes with hollow anode plates generally require a high manufacturing expenditure,

SUMMARY OF THE INVENTION

An object of the present invention is to eliminate the disadvantages associated with the prior art tubes of the type described above. In particular, it is an object of the present invention to provide a optimally simple and cost-effective x-ray tube with improved performance.

This object is achieved in accordance with the invention by an x-ray tube having an anode rotatably mounted on a fixed shaft wherein a fluid to dissipate heat from the anode plate is disposed in an intervening space formed between the anode shaft and the anode plate. As used herein "anode plate", mean a rotationally-symmetrically-formed body extending radially from the anode shaft. The x-ray tube according to the invention is simply designed and can be produced with a relatively low expenditure. The liquid is in direct contact with the anode plate. The inventive construction enables a particularly effective dissipation of the heat from the anode plate to the anode shaft. The inventive x-ray tube can be operated with a higher capacity for a smaller structural shape.

A metal that is liquid at a temperature of less than 100° C., preferably GaInSn, is used as the liquid. As a consequence of its high heat conductivity, such a liquid metal enables a particularly effective heat dissipation to the anode shaft. The liquid can be at least partially accommodated in a capillary structure provided in the intervening space. The capillary structure has a large surface. As a consequence of this, a further improved heat transfer from the liquid to the anode axle is achieved.

In an embodiment, the anode shaft extends into a recess formed in the anode plate. In this manner a contact surface bordering the intervening space can be enlarged, and by the heat dissipation to the anode axle can be improved.

The anode plate can be mounted on the end of an anode tube that rotates on bearings relative to the anode shaft. In another embodiment, the anode shaft extends through a bore in the anode plate. In this case, a particularly large contact surface bordering the intervening space is achieved.

The intervening space is appropriately bordered by at least one seal between the anode shaft and the anode tube. Alternatively, the intervening space is bordered by at least one seal between the anode shaft and the anode plate. The seal is preferably an axial face seal (floating ring seal). Such seals are generally known.

In a further embodiment, the anode shaft is hollow. A cooling device can be provided in the anode shaft. The cooling device can have a cooling inlet for the supply coolant liquid or a heat pipe. Due to the provision of a cooling device, overheating of the anode axle in the region of the anode plate can be prevented and an efficient heat dissipation from the region of the anode axle bordering the intervening space can be ensured.

Preferably the thickness of the anode plate increases from its circumferential edge thereof in the direction toward the anode shaft. Consequently, a particularly large contact surface bordering the intervening space can be provided in the region of the anode shaft. For this purpose, the anode plate can be, for example, trapezoidal in cross-section.

DESCRIPTION OF THE PREFERRED EMBODIMENTS

Figure 1:
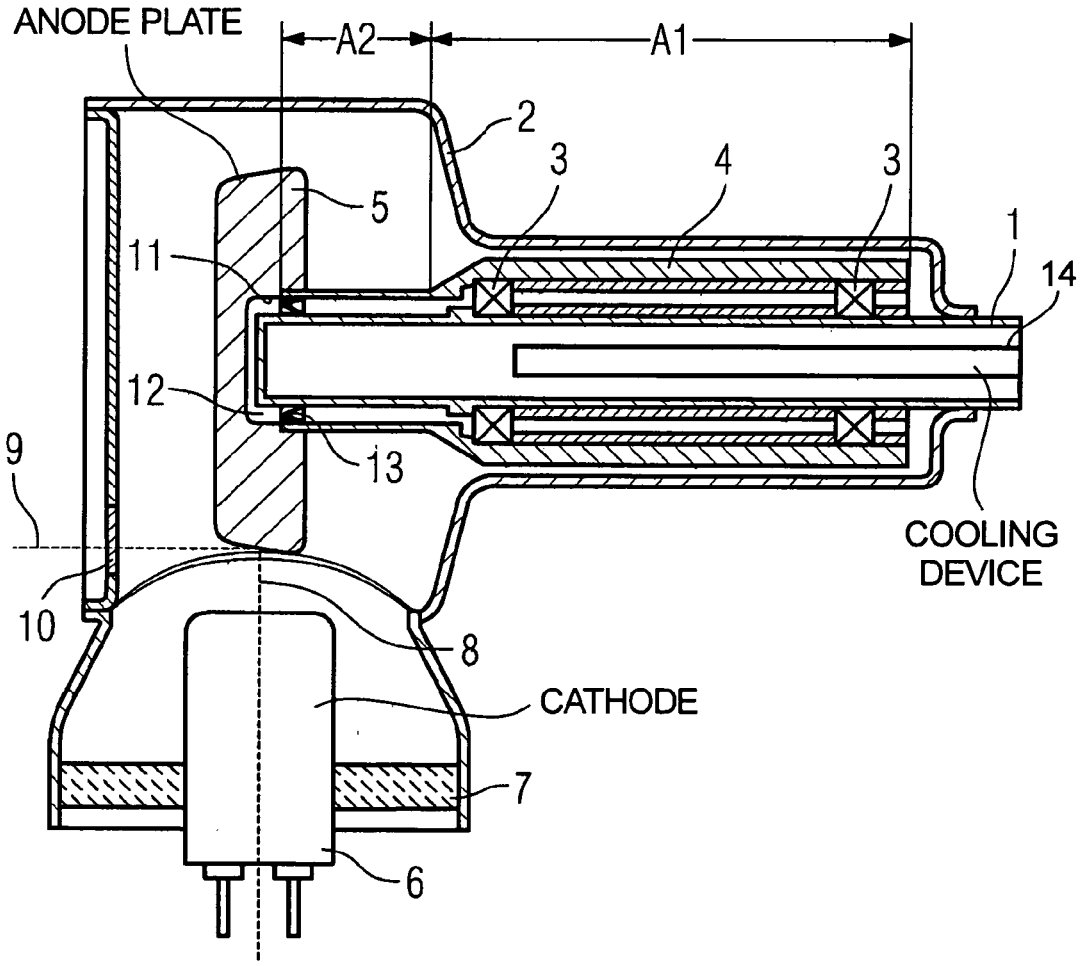
FIG. 1 is a schematic cross-section of a first embodiment of an x-ray tube according to the invention.
Figure 2:
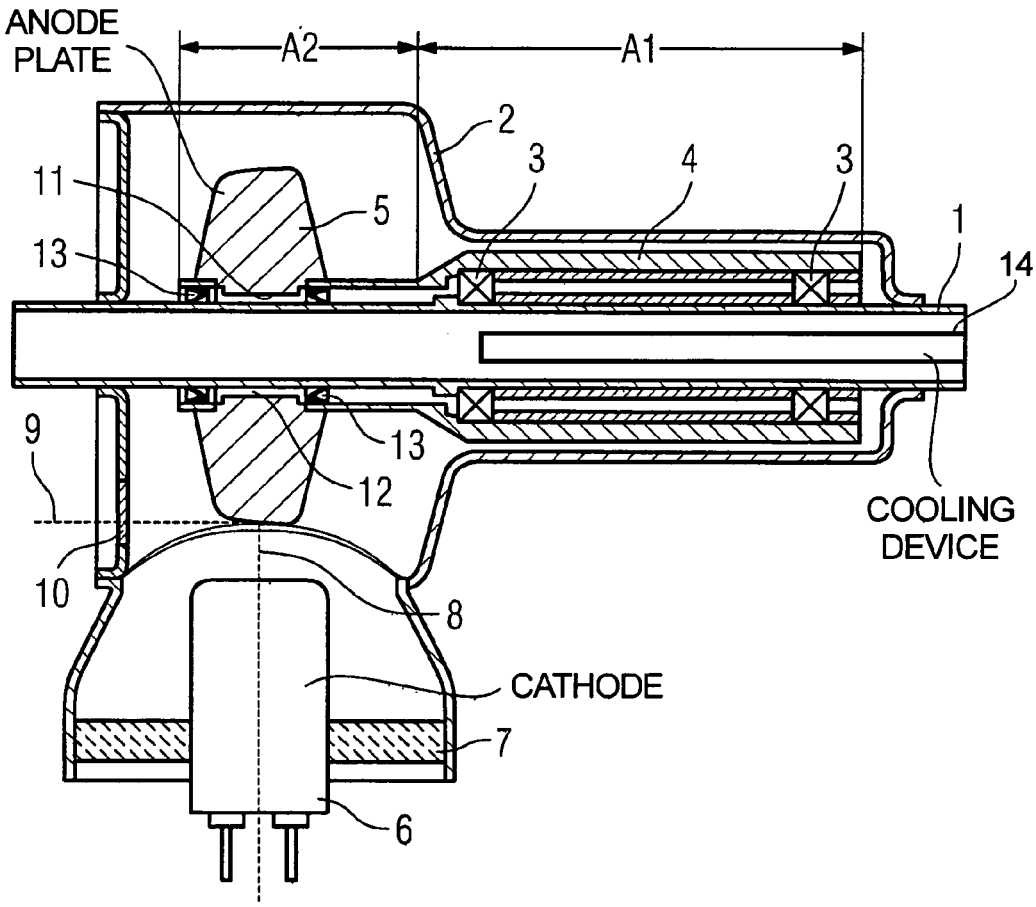
FIG. 2 is a schematic cross-section of a second embodiment of an x-ray tube according to the invention.

In the x-ray tubes shown in FIGS. 1 and 2, a rigid anode shaft 1 extends into a vacuum-sealed housing 2. An anode tube 4 on which an anode plate 5 is mounted is accommodated on the anode shaft 1 such that it can rotate by means of bearings 3. A cathode 6 is disposed radially relative to the anode plate 5 and is mounted in the housing 2 by means of an electrically insulating retainer 7 formed, for example, of a ceramic. An electron beam 8 is directed by the cathode 6 into the anode plate 5, causing x-rays 9 to be radiated from the anode plate 5. The x-ray radiation 9 exits through a window 10 that is transparent for x-rays, provided at the housing 2. The window can be formed, for example, of beryllium.

In a first section A1 extending across the bearing 3, the anode tube 4 exhibits a larger wall thickness than in a second section A2 that extends from the end of the first section A1 to the anode plate 5.

The anode shaft is hollow. A conventional cooling device (not shown) is provided inside of the shaft 1. It can, for example, be a conduit to supply liquid coolant or a heat pipe.

In the first embodiment of the x-ray tube shown In FIG. 1, the anode plate 5 has a recess 11 into which the anode shaft 1 protrudes. An intervening space 12 formed between a closed end of the anode shaft 1 and the recess 11 is sealed by means of axial face seals 13 which are provided between the anode shaft 1 and the second section A2 of the anode tube 4. A metal (not shown here) with a melting point of less than 100° C. is accommodated in the intervening space 12, for example, GaInSn.

In the second embodiment of the x-ray tube shown in FIG. 2, the anode plate 5 has a central bore through which the anode shaft 1 as well as the second section A2 of the anode tube 4 extend. To seal the intervening space 12, two axial face seals 13 are provided between the second section A2 of the anode tube 4 and the anode shaft 1, of which one is arranged in the region of a top side of the anode plate 5 and the other is arranged in the region of a bottom side of the anode plate 5. The anode plate 5 here exhibits a thickness increasing from its circumferential edge toward the shaft 1. The cross-section can—as shown in FIG. 2—be trapezoidal.

Operation of the inventive x-ray tube is as follows:

As a result of the electron beam 8 acting on the anode plate 5, it is heated. Due to the rotation of the anode plate 5, it heats uniformly. Due to the contact of the liquid metal contained in the intervening space 12, the heat of the anode plate 5 is effectively dissipated to the rigid anode shaft 1, which is provided with a cooling device 14. A particularly effective cooling of the anode plate 5 can thus be achieved. The inventive construction can be simply realized in terms of production.

Although modifications and changes may be suggested by those skilled in the art, it is the intention of the inventors to embody within the patent warranted hereon all changes and modifications as reasonably and properly come within the scope of their contribution to the art.

We claim:

1. An x-ray tube comprising:

an anode plate attached to an anode tube, said anode plate being subject to heating during operation of the x-ray tube;

a rigid anode shaft on which said anode tube is rotatably mounted by bearings, said anode shaft projecting into said anode plate with an intervening space formed between said anode shaft and said anode plate;

a liquid that dissipates heat from said anode plate to said anode shaft disposed in said intervening space; and said anode tube having a first section surrounding said bearings and a second section extending from an end of said first section to said anode plate, said second section having a thinner tube wall than said first section to decrease heat flow from said anode plate to said first section of said anode tube.

2. An x-ray tube as claimed in claim 1 wherein said liquid is a metal that is liquid at a temperature of less than 100° C.

3. An x-ray tube as claimed in claim 2 wherein said metal is GaInSn.

4. An x-ray tube as claimed in claim 1 wherein said intervening space forms a capillary structure in which at least a portion of said liquid is disposed.

5. An x-ray tube as claimed in claim 1 wherein said anode plate has a closed recess into which an end of said anode shaft extends, with said intervening space formed between said closed recess and said end of said anode shaft.

6. An x-ray tube as claimed in claim 1 wherein said anode plate has a bore extending therethrough, and wherein said anode shaft proceeds through said bore, with said intervening space formed between an inner wall of said bore and an outer wall of said anode shaft.

7. An x-ray tube as claimed in claim 1 wherein said intervening space is closed by at least one seal between said anode shaft and said anode tube.

8. An x-ray tube as claimed in claim 7 wherein said seal is an axial face seal.

9. An x-ray tube as claimed in claim 1 wherein said intervening space is closed by at least one seal formed between said anode shaft and said anode plate.

10. An x-ray tube as claimed in claim 9 wherein said seal is an axial face seal.

11. An x-ray tube as claimed in claim 1 wherein said anode shaft is hollow.

12. An x-ray tube as claimed in claim 1 comprising a cooling device disposed in said anode shaft.

13. An x-ray tube as claimed in claim 12 wherein said cooling device comprises a cooling conduit adapted to supply cooling liquid.

14. An x-ray tube as claimed in claim 13 wherein said cooling device is a heat pipe.

15. An x-ray tube as claimed in claim 1 wherein said anode plate has a trapezoidal cross-section.

* * * * *